US010180254B2

(12) United States Patent
Brennwald et al.

(10) Patent No.: US 10,180,254 B2
(45) Date of Patent: Jan. 15, 2019

(54) METHOD AND DEVICE FOR PROCESSING SLAG OCCURRING IN A COMBUSTION CHAMBER OF A REFUSE INCINERATION PLANT

(71) Applicant: HITACHI ZOSEN INOVA AG, Zurich (CH)

(72) Inventors: Werner Brennwald, Neftenbach (CH); Volker Wiesendorf, Zurich (CH)

(73) Assignee: HITACHI ZOSEN INOVA AG, Zurich (CH)

( * ) Notice: Subject to any disclaimer, the term of this patent is extended or adjusted under 35 U.S.C. 154(b) by 0 days.

(21) Appl. No.: 15/512,006

(22) PCT Filed: Jul. 6, 2015

(86) PCT No.: PCT/EP2015/065305
§ 371 (c)(1),
(2) Date: Mar. 16, 2017

(87) PCT Pub. No.: WO2016/041652
PCT Pub. Date: Mar. 24, 2016

(65) Prior Publication Data

US 2017/0261205 A1 Sep. 14, 2017

(30) Foreign Application Priority Data

Sep. 16, 2014 (EP) ..... 14003213

(51) Int. Cl.
*F23J 1/00* (2006.01)
*F23J 1/06* (2006.01)
(Continued)

(52) U.S. Cl.
CPC ..... *F23J 1/00* (2013.01); *F23G 5/002* (2013.01); *F23H 7/04* (2013.01); *F23J 1/06* (2013.01);
(Continued)

(58) Field of Classification Search
CPC . F23J 1/00; F23J 1/02; F23J 1/04; F23J 1/06; F23J 1/08; F23J 2700/00; F23J 2700/001;
(Continued)

(56) References Cited

U.S. PATENT DOCUMENTS 2,624,300 A * 1/1953 Honsinger ..... F23J 1/00 110/165 R
3,416,469 A * 12/1968 Dvirka ..... F23J 1/00 110/165 R
(Continued)

FOREIGN PATENT DOCUMENTS

EP 0 446 888 A2 9/1991
GB 2329136 A * 3/1999 ..... B07B 13/07
(Continued)

OTHER PUBLICATIONS

Mar. 30, 2017 International Preliminary Report on Patentability issued in International Patent Application No. PCT/EP2015/065305.
(Continued)

*Primary Examiner* — David J Laux
(74) *Attorney, Agent, or Firm* — Oliff PLC

(57) ABSTRACT

A method processes slag occurring in a combustion chamber. An incineration grate is formed at least in its end region that is facing the slag-removing device as a separating grate, which has openings, via which the chamber is connected to a fine-slag discharge chamber, and at least one fine fraction of the slag is ejected through the openings into the discharge chamber and discharged in a substantially dry state, and the remaining coarse fraction is fed to the slag-removing device and discharged. In this case, the average particle size of the at least one fine fraction is smaller than the average particle size of the coarse fraction. The separating grate has at least in certain regions air feeds that are distributed over its entire width and via which air is fed in a controlled manner to the
(Continued)

slag, and the air feeds are isolated from the openings and formed separately.

18 Claims, 7 Drawing Sheets

(51) Int. Cl.
*F23H 7/04* (2006.01)
*F23G 5/00* (2006.01)
*F27D 15/02* (2006.01)

(52) U.S. Cl.
CPC ... *F23G 2203/101* (2013.01); *F23J 2700/003* (2013.01); *F27D 2015/0233* (2013.01); *F27D 2015/0253* (2013.01)

(58) Field of Classification Search
CPC ..... F23J 2700/002; F23J 2700/003; F27D 15/0213; F27D 15/022; F27D 15/0226; F27D 15/0233; F27D 15/024; F27D 15/0246; F27D 15/026
See application file for complete search history.

(56) References Cited

U.S. PATENT DOCUMENTS 3,686,773 A * 8/1972 Schreiner ..... F27D 15/0213 34/171
4,774,908 A * 10/1988 Liszewski ..... F23G 5/16 110/165 R
4,838,183 A * 6/1989 Tsaveras ..... F23G 5/002 110/101 C
4,987,837 A * 1/1991 Reschly ..... F23G 5/002 110/110
5,476,377 A * 12/1995 Kupper ..... C04B 7/47 432/78
5,671,688 A * 9/1997 Burgin ..... B03B 9/04 110/344
6,038,987 A * 3/2000 Koshinski ..... B02C 19/065 106/705
6,095,064 A * 8/2000 Millard ..... F23G 5/16 110/344
9,579,600 B2 * 2/2017 Brand ..... B01D 53/12

FOREIGN PATENT DOCUMENTS

JP 54-88671 A 7/1979
JP 1-144632 U 10/1989
JP 6-18180 A 1/1994
JP 2003-286522 A 10/2003
JP 2010-223469 A 10/2010

OTHER PUBLICATIONS

English Translation of Mar. 20, 2018 Office Action issued in Japanese Patent Application No. 2017-514461.

* cited by examiner

METHOD AND DEVICE FOR PROCESSING SLAG OCCURRING IN A COMBUSTION CHAMBER OF A REFUSE INCINERATION PLANT

The present invention relates to a method for processing slag occurring in a combustion chamber of a refuse incineration plant in accordance with the preamble of claim 1 and to an incineration grate for carrying out the method. The invention furthermore relates to a combustion chamber of a refuse incineration plant containing an incineration grate of this kind.

In the field of refuse incineration, the solid residues present at the end of the combustion which takes place in the combustion chamber are referred to as slag.

These residues are discharged from the refuse incineration plant by means of a slag removal device, which generally comprises a gravity feed chute, via which the slag falls out of the combustion chamber into a trough filled with water. From said trough, the quenched slag is generally pushed by means of a ram or discharge chain through a discharge chute or discharge track, from where it can be conveyed onward in a form suitable for disposal.

In DE-A-2539615, for example, a description is given of a slag removal device which comprises an arcuate trough filled with water, into which a slag gravity chute opens and on the curved arc of which a discharge piston can be moved backward and forward, pushing the slag quenched in the trough through a rising discharge chute.

Another slag removal device, by means of which the slag is discharged to the outside in a wet state, is disclosed in EP-A-0363645, for instance.

Moreover, a water-filled slag discharge channel is disclosed in DE-C-959399, for instance, said channel being fed with slag by a suitable device and into which dust that falls between the grates is furthermore guided.

With a view to increasing the economic benefits of refuse incineration plants, great efforts have been made for a long time to recover reusable materials from the slag. The focus here is not only on recovering iron but also on recovering nonferrous metals, especially aluminum or copper but also noble metals, such as silver, gold or platinum.

The primary method for recovery is to subject a fine fraction of the slag to a suitable separation process. In the case of iron, this can be recovered by means of magnetic separation, for instance.

However, efficient separation can only be performed on dry slag.

The wet slag discharged by means of the abovementioned prior-art slag removal devices must thus be dried over several weeks while being continuously turned over before the valuable materials can be recovered. Particularly as regards the recovery of aluminum, a significant proportion of the valuable material can be lost just in the drying process. The problem is made worse by the fact that aluminum oxidizes very rapidly in water, thereby being lost to possible recovery. In the case where recovery of valuable minerals is desired, there is the additional fact that bonding reactions can take place even in the wet slag, making recovery not worthwhile or even possible from a technical or economic point of view.

Starting from these disadvantages of wet slag removal, devices for discharging dry slag have been proposed.

Thus, there is a proposal in EP-A-2128279, for instance, for a method in which slag is divided into fractions, whereupon pre-separation is carried out, in which ferrous fractions are removed, and a further separation is carried out, in which nonferrous metallic fractions are removed, wherein the slag is kept in a dry state. To prevent severe dust generation, EP-A-2 128 279 proposes to arrange the corresponding separation device in the immediate vicinity of the outlet of the combustion chamber.

Furthermore, EP-A-1882529, for instance, describes a method for separating residues from a thermal waste treatment process, in which the residues are conveyed downward in a cascade via at least one stage in channels and free-fall sections situated therebetween while a vibratory motion is applied, wherein the fine fraction is removed by a gas stream.

Owing to the gas stream required for this pneumatic separation process, a relatively large quantity of gas, in particular air, is introduced into the interior of the corresponding separating device during this process. However, in order to prevent a reduction in temperature in the combustion chamber, which is unfavorable for burnout and for the energy balance, it must be ensured that as little air as possible with a temperature that is too low enters the combustion chamber and, in particular, the main combustion and burnout zones thereof. Moreover, the method described in EP-A-1882529 requires that the residues fed to the separating device must pass through a relatively large drop in total. Thus, it must be ensured that the residue is fed in at a relatively great height. This, in turn, requires a relatively complex construction of the thermal gravity treatment plant or, alternatively, that means are provided to convey the solid to be separated to said height. Furthermore, relatively complex devices requiring a lot of maintenance, such as a cyclone or filter, are required for separating the fine fraction from the gas stream.

In very general terms, there is the disadvantage both with the method described in EP-A-2128279 and that in EP-A-1882529 that there is considerable dust generation resulting from the conveying of the material and the gas/solid mixture which necessarily forms, and this must be countered by expensive measures.

A method for collecting ash components with a high content of valuable materials is described in JP 2003286522. Here, use is made of an incineration grate which has combustion air openings through which ash can fall and is collected in a hopper. The "porosity" of the incineration grate, as desired by JP 2003286522 to allow the ash to fall through, thus determines the quantity of air passing into the combustion chamber, and this is disadvantageous as regards an optimum energy balance. Moreover, according to the technology described in JP 2003286522, the ash is prevented from being ejected by the air flowing into the combustion chamber in the opposite direction via the combustion air openings.

It is thus the object of the present invention to make available a simple and low-maintenance method for processing slag, which method allows separation of the slag into at least one fine fraction that can be discharged in the dry state and a coarse fraction without the cited disadvantages of the prior art, in particular severe dust generation and a poorer energy balance, occurring. In particular, the method is to be compatible with the construction of conventional grate systems, According to the invention, the object is achieved by the method as claimed in claim 1. Preferred embodiments of the invention are given in the dependent claims.

According to claim 1, the invention thus relates to a method for processing slag occurring in a combustion chamber of a refuse incineration plant that is produced by the refuse that is to be burned being burned on an incineration grate and at the same time conveyed in the direction of a slag removal device.

According to the invention, the incineration grate is now formed at least in its end region that is facing the slag removal device, i.e. even before the slag removal device, as a separating grate. This separating grate has openings, via which the combustion chamber is connected to a fine-slag discharge chamber. At least one fine fraction of the slag is ejected through the openings into the fine-slag discharge chamber and discharged to the outside in a substantially dry state. The remaining coarse fraction is fed to the slag removal device. In this case, the average particle size of the at least one fine fraction is smaller than the average particle size of the coarse fraction.

The separating grate has at least in certain regions air feeds that are distributed over its entire width and via which air is fed in a controlled manner to the slag. In this case, the air feeds are isolated from the openings provided for ejecting the fine fraction and formed separately.

In this context, the term "to the outside" refers to the exterior of the incineration furnace of the refuse incineration plant comprising the combustion chamber, the fine-slag discharge chamber and the slag removal device as well as the refuse feed and the primary air feed.

The invention exploits the insight that the incineration grate in the furnace of the refuse incineration plant can be used not only for burning and conveying the solid material but, given the presence of appropriate openings, can also act as a separating grate, via which at least one fine fraction of the slag can be separated even in the burnout stage. The separating grate thus has the function of a screen, by means of which pre-separation at least of a fine fraction is performed, which can then be subjected in a subsequent step to further separation to recover materials that can be reused.

By virtue of the fact that there are openings in the incineration grate for ejecting at least a fine fraction of the slag, which thus has a certain size, it is fundamentally different from a current incineration grate of the kind disclosed in DE-C-959399, for instance, since, in the latter, the intention is, as far as technically possible, to prevent material from falling through, and therefore there are no openings for the selective ejection of a fraction of the material situated on the grate.

According to the invention, slag components of a corresponding size, i.e. at least a fine fraction, therefore fall out of the combustion chamber via the openings described, at least in said end region of the incineration grate, into the fine slag discharge chamber, while the remaining slag components of larger dimensions, i.e. the coarse fraction, reach the slag removal device. Consequently, bulky slag constituents are separated from the constituents for further separation contained in the fine fractions, which can thus be fed directly, i.e. without a further method step, to the corresponding separation devices—e.g. an eddy current separation device or a separating table.

The problem of dust generation arising in the methods according to EP-A-2128279 and EP-A-1882529, which is caused by the fact that separation into coarse and fine fractions takes place only after release from the combustion chamber, can thus be circumvented according to the invention.

The design of the incineration grate as a separating grate, at least in its end region facing the slag removal device, includes embodiments in which the incineration grate is designed as a separating grate over its entire extent or length.

Through the presence of a fine slag discharge chamber and of a coarse slag discharge chamber and the separation thereby possible of the corresponding slag constituents, the slag discharge device under consideration differs fundamentally from known devices and methods, in which all the slag is fed to a single slag discharge channel or a single slag trough, as is the case, for instance, in the devices disclosed in DE-C-959399 or EP-A-0363645, EP-A-0446888 or U.S. Pat. No. 4,838,183.

As mentioned, the fine fraction that can be obtained according to the invention is of particular relevance to recovery of materials that can be reused. Since it comprises only slag constituents of relatively small particle size, the fine fraction is generally almost completely burnt out.

In contrast, the slag removal device to which a coarse fraction is fed can be assigned a slag processing grate for further processing of the slag constituents contained therein for instance, this being of particular relevance in view of the circumstance that there may still be lumps of combustible material contained in the coarse fraction. A corresponding slag processing grate or a corresponding slag processing device is described in European Patent Application No. 14 000 796.4 (Publication No. EP-A-2778523), the entire contents of which are herewith incorporated by reference.

Since the fine fraction is discharged dry, there is no need for any time- and energy-consuming drying steps before further processing, in particular further separation, e.g. on an eddy current separation device or a separating table, and this contributes to the economy of the method in an obvious way. Moreover, a higher yield of recovered reusable material can be achieved by means of the method since bonding reactions of the kind which can occur in a wet slag are avoided.

The method according to the invention thus makes it possible, starting from the construction of existing refuse incineration plants, to make relatively simple adaptations to separate out a fine fraction, from which reusable materials can then be recovered without complex prior steps for drying having to be carried out to this end. Since the fine fraction is ejected and is thus generally separated from the coarse fraction remaining on the separating grate solely by virtue of gravity, there is no need for any additional separating steps, e.g. additional screening, and this further contributes to the economy of the method.

In order to ensure particularly efficient cooling, the incineration grate and, in particular, the separating grate, comprise, according to another preferred embodiment, grate elements cooled by means of water or air. Corresponding water- or air-cooled grate elements are known to those skilled in the art.

Air-cooled grate elements are particularly preferred for the purposes of the present invention.

According to the invention, the separating grate has at least in certain regions air feeds that are distributed over its entire width and via which air is fed in a controlled manner to the slag. In this way, it is possible to ensure that the slag is cooled to the desired temperature, irrespective of the cooling of the separating grate, and any combustible constituents that may still be present in the slag are fanned without (infiltrated) air at too low a temperature entering the combustion chamber in an uncontrolled manner and thereby compromising the energy balance in the combustion chamber.

According to the invention, control and distribution of the air volume is not accomplished by means of the openings provided for ejection of the fine fraction. On the contrary, the air feeds are isolated from the openings provided for the ejection of the fine fraction and are formed separately. If there are appropriate distribution devices for the air feeds, these too are generally isolated from the openings provided for the ejection of the fine fraction and are formed separately.

The method according to the invention and the incineration grate according to the invention thus differ fundamentally from the method and grate according to EP-A-0446888, in which the air feed simultaneously serves as a collecting channel for the ash falling through the grate. Isolation or separate formation of the air feeds from the openings provided for ejection of the fine fraction, in accordance with the invention, is also not present in the devices and methods disclosed in U.S. Pat. No. 4,838,183 and JP 2003286522.

By means of the isolation, it is possible to ensure that the number and design of the openings for ejection of the fine fraction can be optimized according to the prevailing situation without thereby prejudicing the target variables controlled by means of the air feed, in particular slag cooling and slag burnout. Moreover, by virtue of the fact that the air feed to the slag is controlled, the energy balance in the combustion chamber is maintained at the optimum, which would not be the case with uncontrolled air feed determined by the choice of openings.

Here, the feature that "the separating grate has at least in certain regions air feeds that are distributed over its entire width" means that the separating grate can have air feeds over its entire length (i.e. over its entire extent in the conveying direction) or only in one region thereof.

As mentioned, the average particle size of the at least one fine fraction is smaller than the average particle size of the coarse fraction according to the invention. Here, the smallest extent on average of the individual particles in each case is referred to as the "average particle size".

As explained further below, the Maximum particle size of the slag constituents contained in the fine fraction can be adapted through the extent of the openings. Typically, the coarse fraction differs from the fine fraction in that the coarse fraction contains slag constituents with a particle size greater than 5 mm, preferably greater than 8 mm, as a further preference greater than 10 mm and most preferably greater than 12 mm. In this context too, the smallest extent of the individual particles in each case is referred to as the "particle size".

Of course, the coarse fraction can contain not only slag constituents with the particle sizes mentioned but also slag constituents with a small particle size. According to the embodiment mentioned, however, the fine fraction is free from slag constituents with a particle size greater than 12 mm, preferably free from slag constituents with a particle size greater than 10 mm, preferably free from slag constituents with a particle size greater than 8 mm and most preferably free from slag constituents larger than 5 mm.

Particularly in the case where several fine fractions pass separately out of the combustion chamber into the fine slag discharge chamber—i.e. from different regions of the separating grate—the fine slag discharge chamber can be divided into separate fine slag discharge chamber compartments arranged in series. In general, the respective fine slag discharge chamber compartments are intended successively for a fine fraction with a larger average particle size than the preceding fine slag discharge chamber compartment, when viewed in the conveying direction. Said fine slag discharge chamber compartments can be in the form of hoppers arranged in series in the conveying direction, for instance. In particular, it is conceivable for the individual subfractions or "screen fractions" obtained in this way to be discharged and/or fed to further separating steps separately. Furthermore, the formation of fine slag discharge chamber compartments is also worthwhile from a design point of view, irrespective of whether several fine fractions are to be separated or not.

As a further preference, the fine-slag discharge chamber is assigned fine-slag discharge means, which are designed in such a way that the fine fraction of the slag, i.e. the fine slag, is discharged to the outside, i.e. out of the fine slag discharge chamber, substantially in an airtight manner. Consequently, it is ensured that no (infiltrated) air can enter the slag processing device or the combustion chamber apart from the air fed in in a controlled manner via the air feeds.

As mentioned, the fine fraction entering the fine slag discharge chamber is discharged to the outside in a substantially dry state according to the present invention. Consequently, at least the fine slag discharge means are designed to discharge the fine fraction in a substantially dry state. The fine slag discharge thus differs fundamentally from the slag discharge systems disclosed in DE-A-2539615, EP-A-0363645 and DE-C-959399, for instance, in which the slag is received in a water charge, quenched and then discharged.

In addition to the fine slag discharge means, the coarse slag discharge means can also be designed to discharge the coarse fraction in a substantially dry state. As an alternative, however, it is also conceivable and, depending on the given technical and economic boundary conditions, preferred that discharge of the coarse fraction should take place in the wet state.

The fine slag discharge means preferably form a lock. It is conceivable, for instance, that the fine slag discharge means are in the form of shutoff devices, e.g. shutoff slides or shutoff flaps, which can be actuated at different times. By means of these shutoff devices, it is possible to enclose a lock chamber, into which the fine slag is introduced from the fine slag discharge chamber when the first shutoff device is open and the second shutoff device is closed and said fine slag can be discharged when the first shutoff device is closed and the second shutoff device is open. In this regard, it is conceivable to provide evacuation means for the at least partial evacuation of the lock chamber while the shutoff devices are simultaneously closed. This makes it possible to remove the air entering said lock chamber from the outside when the corresponding shutoff device is open and thus to prevent this air from entering the combustion chamber.

Consequently, as regards the fine slag discharge according to the invention, it is possible to ensure that the interior of the furnace is closed off airtightly from the outside. Thus, the air volume fed to the combustion chamber for primary combustion and the temperature can be better controlled; the problem of infiltrated air which could enter the combustion chamber owing to the fine slag discharge according to the invention thus does not arise.

There are several possibilities for the design configuration of the separating grate and of the grate elements of the separating grate, and these can also be combined with one another: where grate bars are used as grate elements, the formation of openings by holes in the grate bars and/or by gaps between the grate bars, alternatively or in addition the use of screens as grate elements, these being designed as barrel-type screens, disk screens, star screens or the like.

For purposes of the present invention, it is possible, in particular, to use an incineration grate with known grate blocks. According to the invention, the term "grate block" also includes grate bars. However, grate plates, e.g. grate plates extending over the entire width of the incineration grate for example, are also conceivable in this regard.

The openings are preferably arranged in the upper wall of the grate elements or are formed between the upper walls of in each case two grate elements adjacent in the transverse direction.

According to an embodiment which is particularly simple in terms of production technology, the openings are in the form of holes in the grate elements. These holes can be adapted as desired in extent and shape to the respective aims. In particular, they can have a circular, oval or polygonal, in particular rectangular, cross section. If openings are formed by gaps between the grate elements, this is accomplished by forming the gaps in each case by means of two grate elements spaced apart from one another in the transverse direction, This includes embodiments in which the separating grate has grate beams with a longitudinal axis extending in the conveying direction of the separating grate and in which grate blocks are secured laterally on one grate beam in each case, such that the grate blocks secured on a first grate beam are spaced apart on the side thereof facing away from the first grate beam from a second grate beam following on from the first grate beam in the transverse direction, with the result that a gap is formed between the respective grate block and the second grate beam. In this embodiment, a first set of grate elements is thus in the form of grate blocks and a second set of grate elements is in the form of grate beams.

According to a particularly preferred embodiment, the grate beams in this embodiment can furthermore assume the function of the distribution device for the air feeds, in this case, the grate beams are generally designed as hollow bodies, from which air lines branch off to the respective grate blocks or the air feeds of the grate blocks.

According to a preferred embodiment, at least the separating grate but preferably the entire incineration grate is in the form of a forward-feed grate or reverse-feed grate. In a forward-feed grate or reverse-feed grate of this type, the grate elements are designed in such a way as to turn over and/or convey the slag by means of feed movements performed relative to one another. In this case, the gaps forming the openings for ejecting the fine fraction particularly are preferably designed in such a way that the cross section thereof is varied during a feed movement. On the one hand, this makes it possible to enhance the screening effect of the separating grate. On the other hand, the fact that it is possible to move the gap walls relative to one another makes it possible to counteract lamming of bulky slag constituents in an effective manner by ejecting these from the gap or pulverizing them between the gap walls so that ultimately they fall down through the openings as a fine fraction.

According to the invention, the grate elements are arranged so as to rest one upon the other in the manner of steps in the conveying direction of the solid material to be burned. In other words, they rest at the front on the respective grate elements arranged downstream in the conveying direction. Thus, such a separating grate differs fundamentally from the device disclosed in EP-A-1882529, in which residues are conveyed downward in a cascade with the application of a vibratory movement.

As mentioned, at least part of the separating grate can furthermore be in the form of a screen, e.g. in the form of a barrel-type screen, disk screen or star screen. In particular, it is possible to conceive of combining individual separating grate segments in which the openings are of different designs, i.e. of providing, in a first region, a separating grate segment in which the openings are in the form of holes in the grate bars and/or of gaps between the grate bars, for example, and in the form of a disk screen in another separating grate segment.

In the context of the present invention, "transverse direction" refers to the direction transverse to the conveying direction of the incineration grate or separating grate. Accordingly, the "width of the separating grate" refers to the extent of the separating grate transversely to the conveying direction.

According to a particularly preferred embodiment, the fine fraction contains only particles, the maximum particle size of which is at most 12 mm, preferably at most 10 mm, as a further preference at most 8 mm, and most preferably at most 5 mm. Accordingly, the openings of the separating grate are preferably designed in such a way as to allow through only particles with a maximum particle size of at most 12 mm, preferably at most 10 mm, as a further preference at most 8 mm, and most preferably at most 5 mm.

The maximum particle size of the particles contained in the fine fraction is preferably in a range of from 5 mm to 12 mm, preferably 5 mm to 10 mm, If the openings of the separating grate are in the form of gaps between the grate elements, the grate elements are accordingly spaced apart preferably by at most 12 mm, more preferably at most 10 mm, as a further preference by at most 8 mm and most preferably by at most 5 mm. Depending on the type or particle size distribution of the coarse fraction and of the fine fraction, however, other spacings or other gap widths are also conceivable.

As a particularly preferred option, the grate elements, in particular the grate blocks, each have a wearing plate, which is mounted on a base body, designed as a casting, of the respective grate element. Since the dimensions of the wearing plate are chosen in such a way that it projects laterally beyond the base body, the gap width and thus the cross section of the openings can be adapted by very simple means.

For the above embodiments, in which there is a spacing of at most 12 mm between the grate elements or between the grate block and the grate beam, a spacing of 12 mm between the respective grate element base bodies or between the grate block base body and the grate beam is preferably chosen. As mentioned, this spacing can be reduced by means of wearing plates as required. In the case where grate blocks and grate beams are present, it is conceivable that a wearing plate is arranged on the base body of each grate block, on the base body of a grate beam or on both.

The number and arrangement of the grate elements can be chosen arbitrarily and can be adapted appropriately, depending on requirements. For the embodiment in which the separating grate has grate beams and grate blocks, it is preferred that in each case a series of grate blocks arranged one above the other in the manner of steps is arranged between two grate beams. However, it is also conceivable that several rows, e.g. two, three or four rows, of grate blocks arranged one above the other in the manner of steps are arranged between two grate beams.

For the case where the openings are designed as holes, the smallest extent of the opening in cross section is at most 12 mm, more preferably at most 10 mm, as a further preference at most 8 mm and most preferably at most 5 mm, in analogy with the above statements.

In order to achieve a sufficiently high yield of ejected fine fraction, the spacing between two grate elements forming a gap or the smallest extent, in cross section, of the opening is generally at least 1 mm, preferably at least 2 mm, more preferably at least 3 mm and most preferably at least 4 mm.

In some circumstances, there may be a desire for incineration of the refuse and the conveyance thereof to be impaired as little as possible precisely in those zones of the incineration grate which are ahead of the burnout zone. Given this situation, there may be a preference, according to one specific embodiment, for the incineration grate to be designed as a separating grate only in its end region facing the slag removal device, preferably only in the burnout zone. According to this embodiment, therefore, the at least one fine fraction of the slag is injected into the fine slag discharge chamber only in the burnout zone. Moreover, this has the further advantage that the fine fraction ejected from this zone is substantially free of material that is still capable of burning, in particular free of plastic and organic material, since said materials have already burnt completely before the entry of the combustible material into the burnout zone.

Particularly if the openings are in the form of holes in the grate elements, there may be a preference for the separating grate to have openings with different cross-sectional areas, wherein the extent of the cross-sectional area of the openings increases when viewed in the conveying direction.

This embodiment, in particular, makes it possible to transfer several fine fractions with increasing average particle size successively into the fine slag discharge chamber. In particular, it is possible, by means of this embodiment, to ensure that particles with a particularly small average particle size are removed from the separating grate at an early stage.

As mentioned above, it is particularly advantageous for this embodiment if the fine slag discharge chamber is divided into separate fine slag discharge chamber compartments, wherein the respective fine slag discharge chamber compartments are intended successively for a fine fraction with a larger average particle size than the respectively preceding fine slag discharge chamber compartment, when viewed in the conveying direction. Thus, the ejected sand can also be discharged from the combustion chamber separately from the fine fraction(s) of larger average particle size.

If the incineration grate is designed as a forward-feed grate or as a reverse-feed grate, the separating grate is generally also designed as a forward-feed grate or as a reverse-feed grate. Depending on the goals pursued, however, the separating grate can be assigned further means for longitudinal, transverse and/or vertical movement, e.g. vibration elements. Owing to the turnover or even fluidization thereby obtainable in the material on the separating grate, the separating effect is promoted.

According to another aspect, the present invention furthermore relates to an incineration grate for carrying out the method described above. It comprises a plurality of grate elements, which rest one upon the other in the manner of steps in the conveying direction of the refuse to be burned and thus form grate steps. As described above, the incineration grate is, according to the invention, designed as a separating grate, at least in the end region thereof situated downstream in the conveying direction, which separating grate has openings for ejecting at least a fine fraction of the slag. In this case, the separating grate has at least in certain regions air feeds that are distributed over entire width for the controlled supply of air to the slag, wherein the air feeds are isolated from the openings provided for ejecting the fine fraction and are formed separately.

As mentioned, the incineration grate according to invention also includes embodiments in which the incineration grate is designed as a separating grate over its entire extent or over its entire length but, according to a particularly preferred embodiment, the incineration grate is designed as a separating grate only in the end region which is intended to face the slag removal device, preferably only in the burnout zone.

As likewise mentioned, the openings are preferably in the form of gaps between the grate elements and, in particular, are each formed by two grate elements spaced apart in the transverse direction.

The preferred embodiments described in connection with the method according to the invention likewise represent preferred embodiments of the incineration grate. Conversely, all the preferred features according to the invention described in connection with the incineration grate represent preferred features of the method.

As already mentioned in connection with the method according to the invention, it is possible, in particular, for the incineration grate to be designed as a forward-feed grate or reverse-feed grate. Thus, in this embodiment, the grate elements are designed in such a way as to turnover and/or convey the slag by means of feed movements performed relative to one another. In this respect, it is furthermore preferred that the cross section of the openings provided for ejecting the fine fraction of the slag, in particular of the gaps, is varied during the feed movement.

As furthermore already mentioned, it is moreover conceivable that the incineration grate has grate beams with a longitudinal axis extending in the conveying direction of the incineration grate, and grate blocks are secured laterally on one grate beam in each case. In this case, the grate blocks secured on a first grate beam are spaced apart, on the side thereof facing away from the first grate beam, from a second grate beam following the first grate beam in the transverse direction, with the result that a gap is formed between the respective grate block and the second grate beam. In this embodiment, a first set of grate elements is thus in the form of grate blocks and a second set of grate elements is in the form of grate beams.

In order to ensure selective conveyance of the slag via the openings and thus an optimum screening effect, at least some of the grate beams can have corresponding deflection elements (or baffles) on their upper side facing the slag. This can be of approximately wedge-shaped design.

Given appropriate arrangement of these deflection elements, a meandering course of different subsidiary slag flows can be obtained, in particular, this being particularly advantageous in respect of a good screening effect. It is conceivable, for instance, that the deflection elements are arranged offset with respect to one another in the conveying direction of grate beams that follow one another in the transverse direction of the incineration grate, in particular that the deflection elements of grate beams that follow one another in the transverse direction are arranged along a zigzag line.

It is furthermore preferred that the proportion of the sum of the cross-sectional area of the openings and the air feeds to the total area of the separating grate facing the slag is more than 5%, preferably more than 6% and most preferably more than 7%. It is thereby possible to achieve a very high yield of the fine fraction which is of particular interest in terms of recovery of valuable materials, in particular a fine fraction with a maximum particle size of at most 12 mm.

According to another aspect, the present invention furthermore relates to a combustion chamber of a refuse incineration plant containing the incineration grate, including the separating grate, described above.

The invention is illustrated further by means of attached figures, of which:

Figure 1:
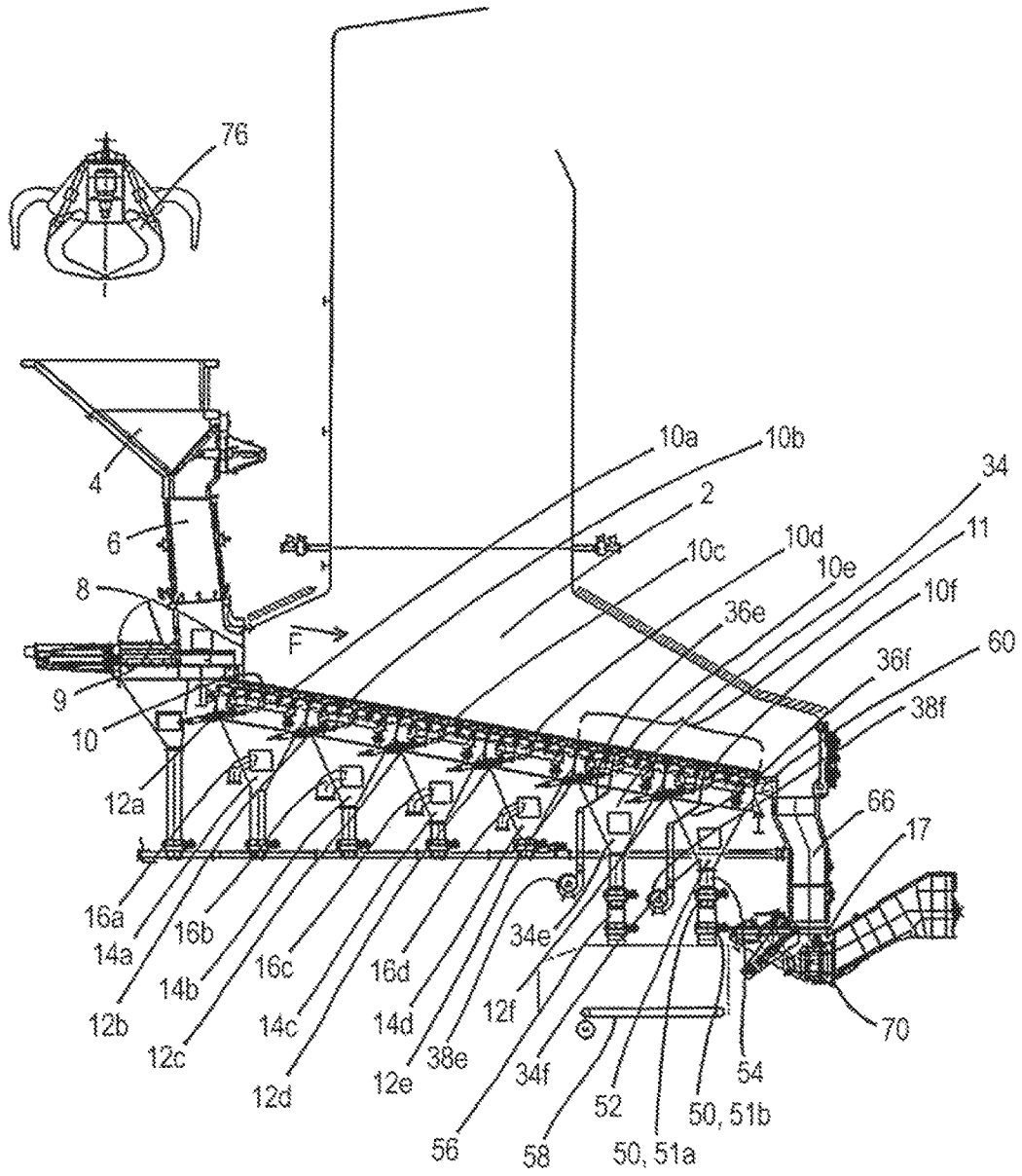
FIG. 1 shows a technical drawing of an incineration furnace of a refuse incineration plant comprising a combustion chamber, an incineration grate, a refuse feed and a primary air feed, a slag removal device and a fine slag discharge chamber, divided into two fine slag discharge chamber compartments, for carrying out the method according to the invention.

As shown in FIG. 1, the refuse incineration plant comprises a combustion chamber 2, arranged upstream of which is a refuse feed hopper 4 with a refuse chute 6 connected thereto, which is connected to the combustion chamber 2 via an inlet 8.

The combustion chamber 2 comprises an incineration grate 10 in the form of a forward-feed grate forming the lower boundary of said chamber. In the embodiment shown, the incineration grate 10 is divided into six incineration grate sections 10*a*, 10*b*, 10*c*, 10*d*, 10*e*, 10*f*, to each of which two drives 12*a*, 12*b*, 12*c*, 12*d*, 12*e*, 12*f* that can be operated in phase opposition are assigned. (Of these two drives, only a single drive is shown in each case in FIG. 1.)

Arranged below each of the first four incineration grate sections 10*a*, 10*b*, 10*c*, 10*d* is an undergrate air chamber 14*a*, 14*b*, 14*c*, 14*d*, into each of which a separate primary air line 16*a*, 16*b*, 16*c*, 16*d* opens and which is intended to feed primary air to the combustion bed via corresponding primary air ducts in the incineration grate sections 10*a-d*.

At the downstream end of the incineration grate 10, when viewed in the conveying direction F, there is an adjoining slag removal device 17. This comprises a coarse slag ejection chute 66 and a coarse slag collecting trough 70.

In the embodiment shown in FIG. 1, the incineration grate 10 in the forwardmost incineration grate sections when viewed in the conveying direction F, i.e. the fifth and sixth incineration grate sections 10*e*, 10*f*facing the slag removal device 17, is in the form of a separating grate 11. This separating grate has openings, via which the combustion chamber 2 is connected to a fine slag discharge chamber 34. (The openings are not visible in FIG. 1.)

In the embodiment shown in FIG. 1, the fine slag discharge chamber 34 is divided into two fine slag discharge chamber compartments 34*e*, 34*f*, which are in the form of hoppers 52, which are each arranged below the corresponding incineration grate sections 10*e*, 10*f*. In the embodiment shown, there is no separation into several fine fractions; after passing through the fine slag discharge chamber compartments 34*e*, 34*f*, the fine fractions from the fine slag discharge chambers are carried away jointly by means of a conveyor belt 58.

Figure 3:
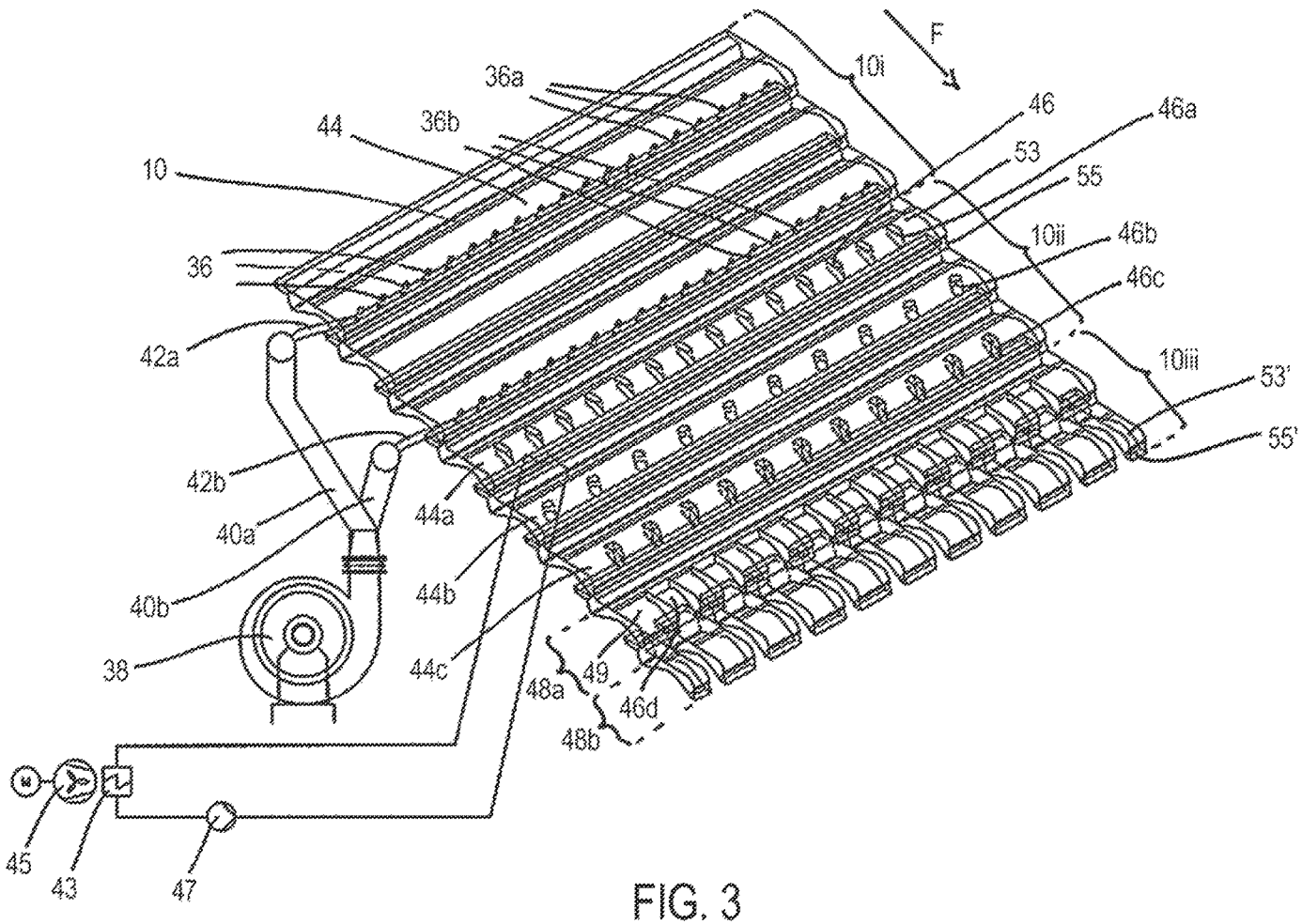
FIG. 3 shows a technical drawing of part of an incineration grate according to the present invention in a perspective view with several options for the design of the openings.

The fifth and sixth incineration grate sections 10*e*, 10*f* are furthermore assigned air feeds 36*e*, 36*f* for feeding in air in a controlled manner. The air feeds 36*e* and 36*f* respectively allocated to an incineration grate section 10*e* and 10*f* are each connected to an air blower 38*e* and 38*f*, respectively. As shown in FIG. 3, the connection between the air blower 38 and the air feeds 36 or 36*a*, 36*b* is generally made via corresponding air lines 40*a*, 40*b* and air distributor rails 42*a*, 42*b*.

Figure 2:
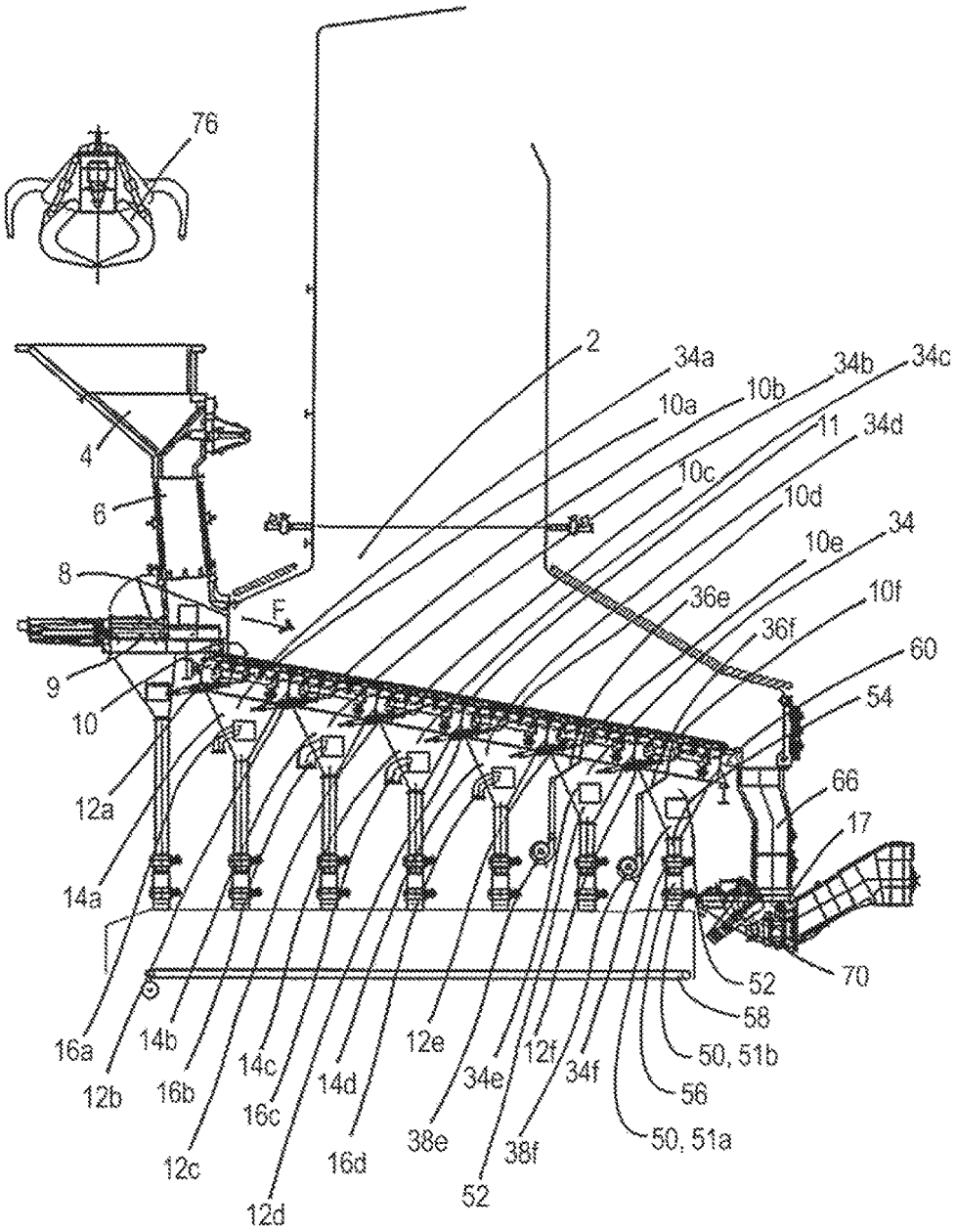
FIG. 2 shows a technical drawing of another incineration furnace for carrying out the method according to the invention.

The embodiment according to FIG. 2 differs from that according to FIG. 1 in that the entire incineration grate 10 is designed as a separating grate 11. Consequently, it has openings in all its incineration grate sections 10*a-f*, via which the combustion chamber is connected to fine slag discharge chamber compartments 34*a-f*. Here, the fine slag discharge chamber compartments 34*a*, 34*b*, 34*c* and 34*d* arranged beneath the first four incineration grate sections 10*a-d* are formed by the respective undergrate air chambers 14*a*, 14*b*, 14*c* and 14*d*. In the embodiment shown, there is no separation into several fine fractions; after passing through the fine slag discharge chamber compartments 34*a-f*, the fine fractions from the fine slag discharge chambers are carried away jointly by means of a conveyor belt 58.

As mentioned, the fine slag discharge chamber 34 in the embodiment shown in FIGS. 1 and 2 is divided into fine slag discharge compartments 34*e-f* and 34*a-f* respectively, which are each in the form of a hopper 52. In the hopper neck 54, i.e. the narrowest region of the hopper 52, there are fine slag discharge means 50 in the form of two fine slag shutoff slides 51*a*, 51*b* arranged one above the other, which each alternately open and airtightly close the passage 56 defined by the hopper neck 54 and in this way form a lock. Arranged underneath the lower fine slag shutoff slide 51*b* and as an extension of the hopper neck 54 is a conveyor belt 58, which, in FIG. 2, is of significantly longer configuration than the conveyor belt 58 according to FIG. 1 owing to the fact that the entire incineration grate is designed as a separating grate.

The openings which, according to the invention, are present in that region of the incineration grate 10 which is designed as separating grate 11, as well as the air feeds, are illustrated in greater detail by means of FIG. 3.

That part of an incineration grate 10 which is shown in FIG. 3 has a first grate segment 10*i*, in which the incineration grate 10 has air feeds 36 distributed over its entire width.

Adjoining the first grate segment 10*i* in the conveying direction F in the embodiment shown in FIG. 3 is a second grate segment 10*ii*. In the embodiment shown, this does not have any air feeds but—as illustrated schematically in the figure—is cooled by means of water. Here, the water is circulated in a circuit, in which there is a heat exchanger 43 and a fan 45 associated therewith for cooling the water and in which the cooled water is passed through corresponding cavities in the incineration grate and passed back from the latter to the heat exchanger 43 by means of a pump 47.

Although it is not shown explicitly in the figure, it is preferred that—in addition to the second grate segment 10*ii*—other grate segments, in particular the first grade segment 10*a*, also have water-cooled grate elements. It is furthermore conceivable that—in addition to the first grate segment 10*i*—there are air feeds also in other grate segments, in particular in the second grate segment 10*ii*.

In the embodiment shown in FIG. 3, the incineration grate 10 in the first and second grate segments 10*i*, 10*ii* is formed by grate plates 44, which extend over the entire width of the incineration grate 10. Of course, it is also conceivable for these grate segments to be constructed from grate blocks.

The grate plates 44 have an upper wall 53, which forms a supporting surface, and a wall 55 at the front when viewed in the conveying direction F of the grate, wherein the air feeds 36 in the embodiment shown are arranged in the upper wall 53 or open via the upper wall into the combustion chamber 2. However, it is also conceivable that the air feeds 36 are arranged in the front wall 55 or open into the combustion chamber 2 via the front wall.

Figure 4:
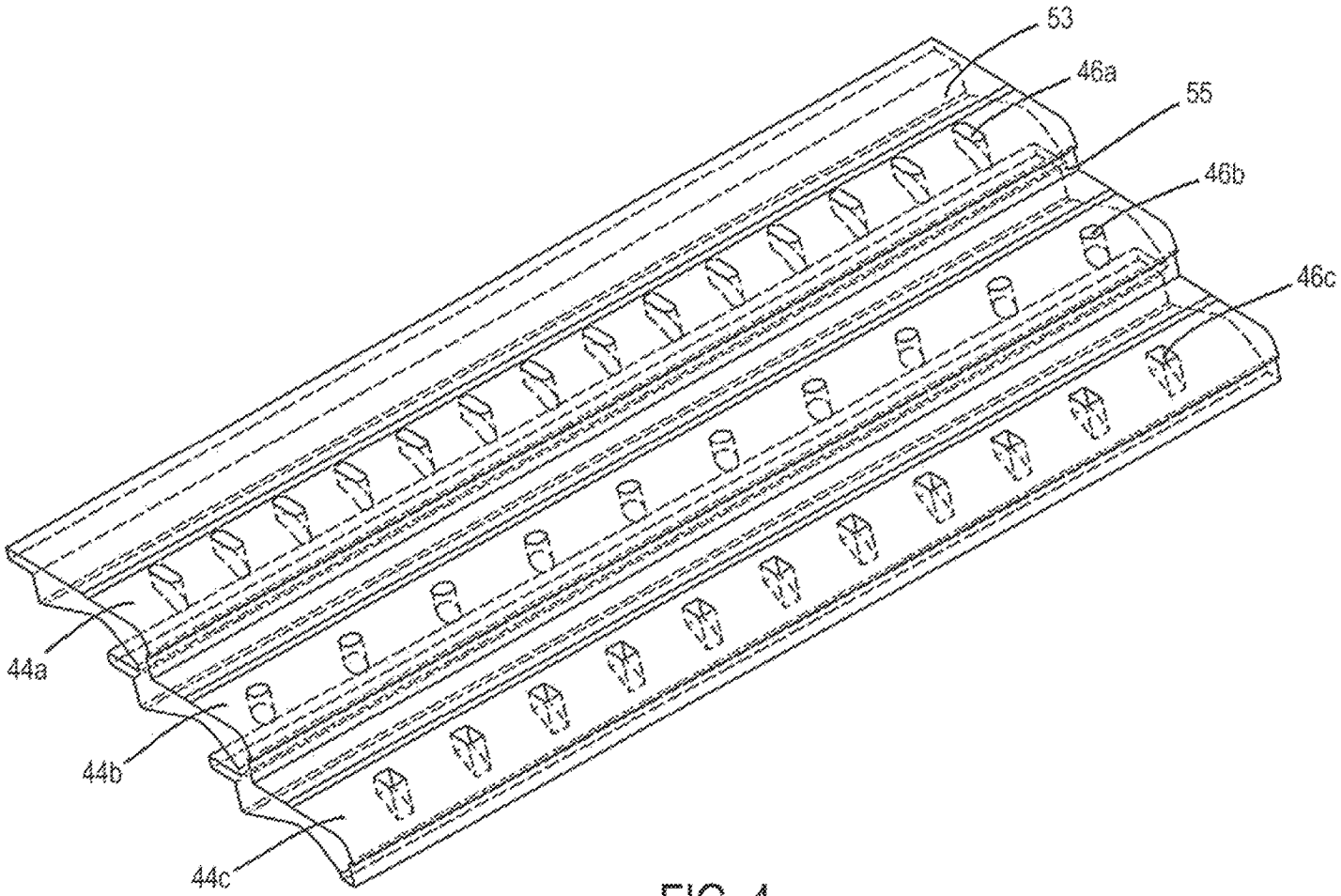
FIG. 4 shows an enlarged view of a grate segment, comprising three grate steps, of the incineration grate shown in FIG. 3, with openings which are formed by holes in the grate bars, said holes varying in their respective geometry from grate stage to grate stage.

The second grate segment 10*ii* has openings 46, which have different cross-sectional geometries in each of the three grate plates of this segment in the embodiment shown, as can furthermore also be seen from FIG. 4. Of course, it is also conceivable to choose the same cross-sectional geometry for each grate step. To this extent, FIGS. 3 and 4 serve merely to indicate possible openings without the need for all of these to be implemented in one and the same embodiment of the incineration grate.

In the specific case, in the purely illustrative illustration in FIGS. 3 and 4, the openings 46*a* of that grate plate 44*a* of the second incineration grate segment 10*ii* which is the first when viewed in the conveying direction F are in the form of holes or slots, which, in the specific case, have the shape of a rectangle with rounded corners in cross section. The openings 46*b* of the second grate plate 44*b* of the second incineration grate segment 10*ii*, in contrast, are in the form of holes of circular cross section, while the openings 46*c* of the third grate plate 44*c* of the second incineration grate segment 10*ii* are in the form of holes with a square cross section. Of course, any other geometries ire conceivable apart from those shown.

Figure 5:
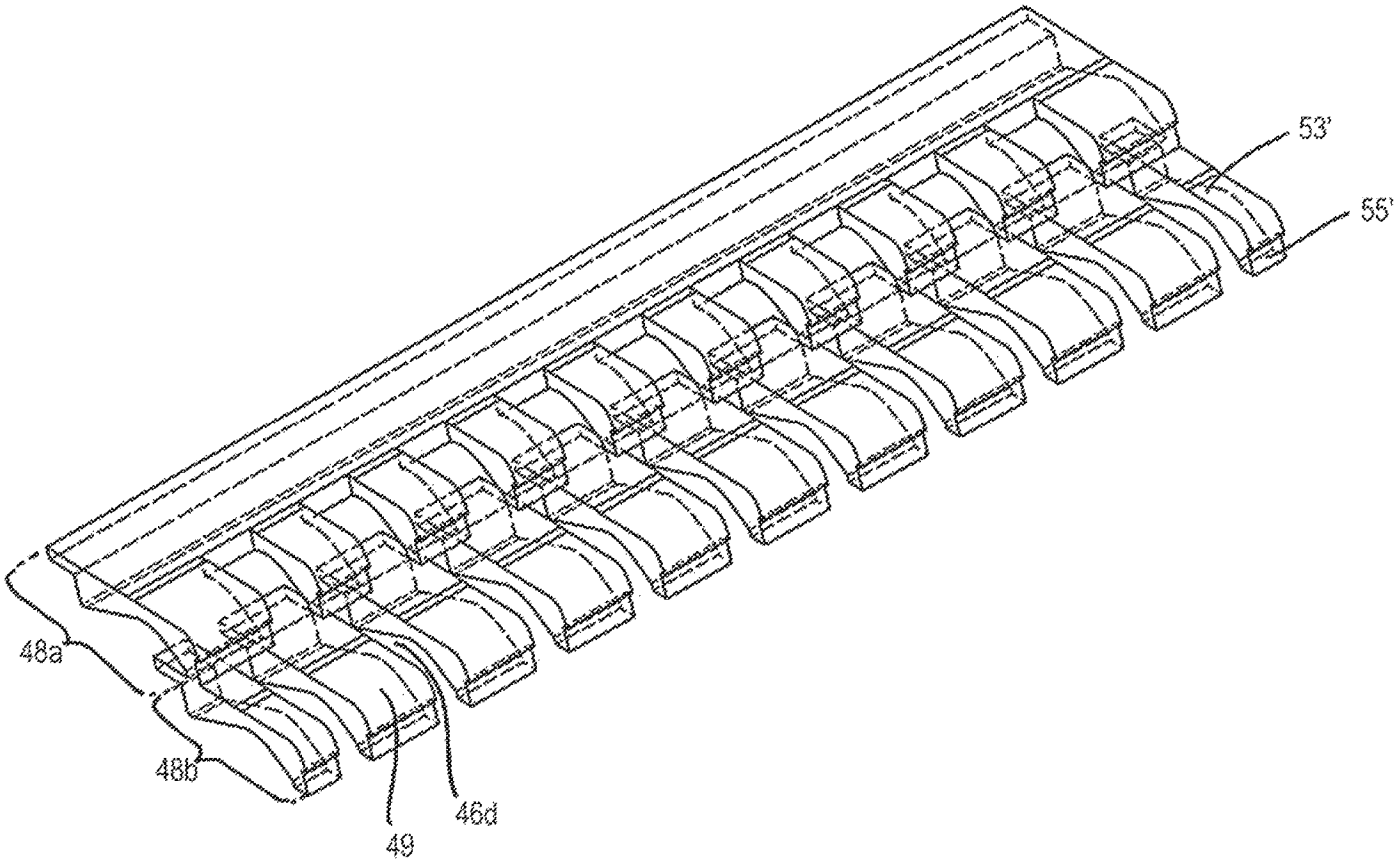
FIG. 5 shows an enlarged view of the forwardmost grate segment of the incineration grate shown in FIG. 3, with openings formed by gaps between the grate bars.

Adjoining the second grate segment 10*ii* in the conveying direction F is a third grate segment 10*iii*, which is shown on an enlarged scale in FIG. 5. In this third grate segment 10*iii*, the individual grate elements are in the form of grate blocks 49 (each likewise having an upper wall 53' and a front wall 55'), which are arranged spaced apart in the transverse direction, i.e. transversely to the conveying direction F, with the result that there is in each case a gap between two grate blocks, as can also be seen especially from FIG. 5. These gaps form further openings 46*d*, via which the combustion chamber 2 is connected to the fine slag discharge chamber 34.

In the embodiment shown, the gap widths are of larger design in a first grate step 48*a* than the gap widths of a second grate step 48*b* arranged downstream of the first grate step in the conveying direction F. Of course, it is also conceivable that at least some of the gaps forming the openings are formed by merely omitting part of the respective grate block.

By virtue of the presence of corresponding openings 46*a-d*, the second and third grate segments 10*ii* and 10*iii* form a separating grate 11 for ejecting a fine fraction of the slag.

As mentioned, the arrangement of the openings which is shown in FIG. 3 is used merely to illustrate the fact that any geometries of the openings in any arrangement are possible. In particular, it is conceivable to provide only holes 46*a-c* or only gaps 46*d* as openings in all of the grate segments formed as a separating grate 11.

Figure 6:
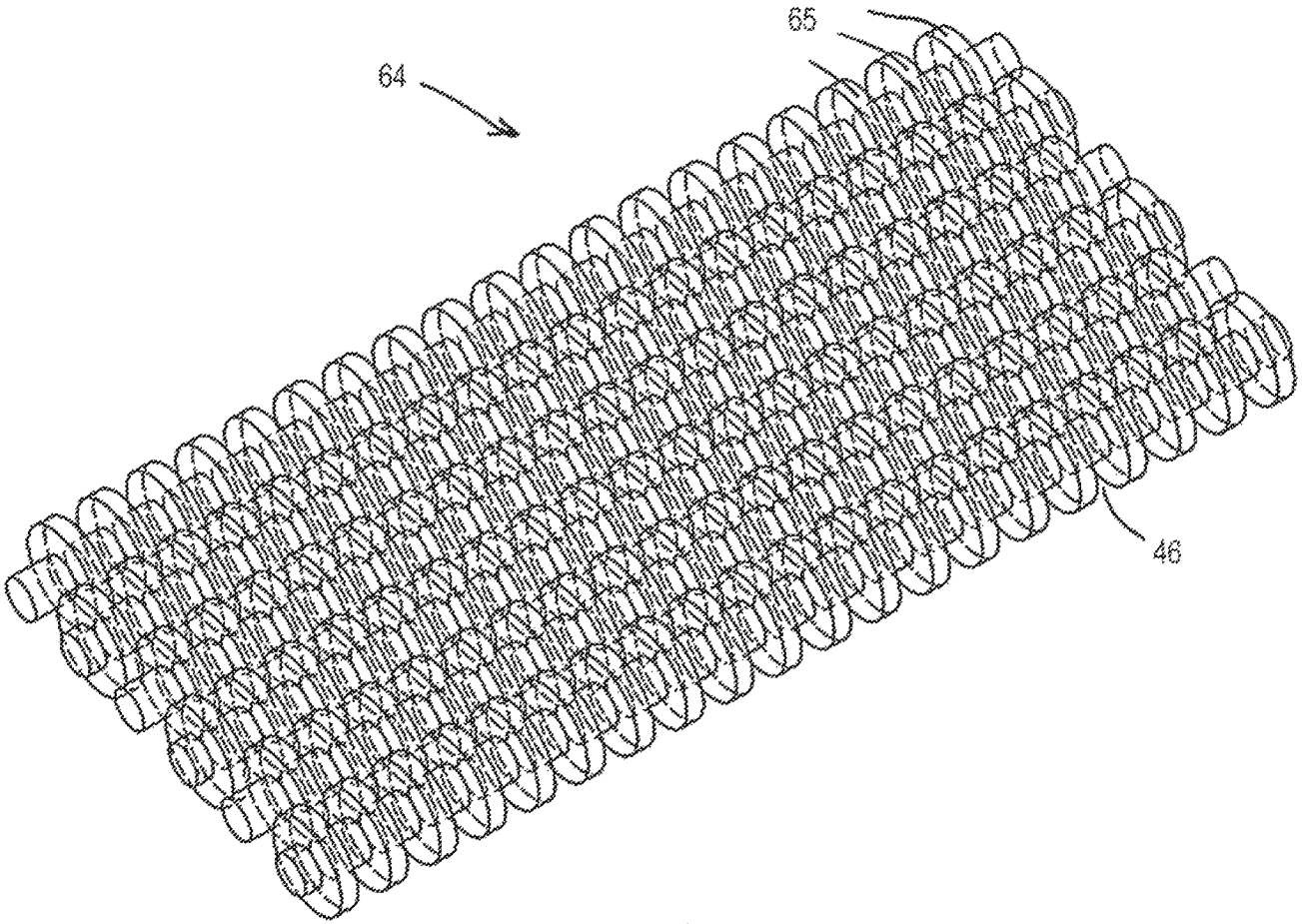
FIG. 6 shows a technical drawing of a separating grate in the form of a disk screen for an incineration grate according to the invention.

It is furthermore conceivable to design at least part of the separating grate as a disk screen 64, as illustrated in FIG. 6. In this case, the openings 46 are formed by the interspaces between the disks 65. Of course, other types of screen are also conceivable.

During operation, the refuse to be burned is discharged into the refuse feed hopper 4 and the adjoining refuse chute 6 by means of a crane, of which only the refuse grab 76 is shown in FIG. 1 and FIG. 2.

At the outlet of the refuse chute 6, the refuse is pushed by means of corresponding charging rams 9 through the inlet 8 into the combustion chamber 2 or onto the incineration grate 10, from where the refuse is conveyed in the form of a combustion bed in the direction of the slag removal device 17. In this case, the refuse passes through several combustion phases, namely a drying phase, an ignition phase, a main combustion phase and a burnout phase. These phases are assigned to corresponding zones on the incineration grate 10, i.e. drying zone, an ignition zone, a main combustion zone and a burnout zone.

As soon as the refuse or slag is conveyed over the separating grate 11, slag components of appropriate size, i.e. the fine fraction or fine slag, fall out of the combustion chamber 2 into the fine slag discharge chamber 34 through the openings 46. The remaining coarse fraction or coarse slag, which comprises slag components of relatively large dimensions, passes via a coarse slag ejection edge 60 into the coarse slag discharge chute 66 and, via the latter, into the coarse slag collecting trough 70 of the slag removal device 17, from where it is discharged to the outside.

Consequently, bulky slag constituents are separated from the fine constituents for further separation, and can thus be fed directly to the corresponding separation devices in order to recover from the slag materials that can be reused.

Figure 7:
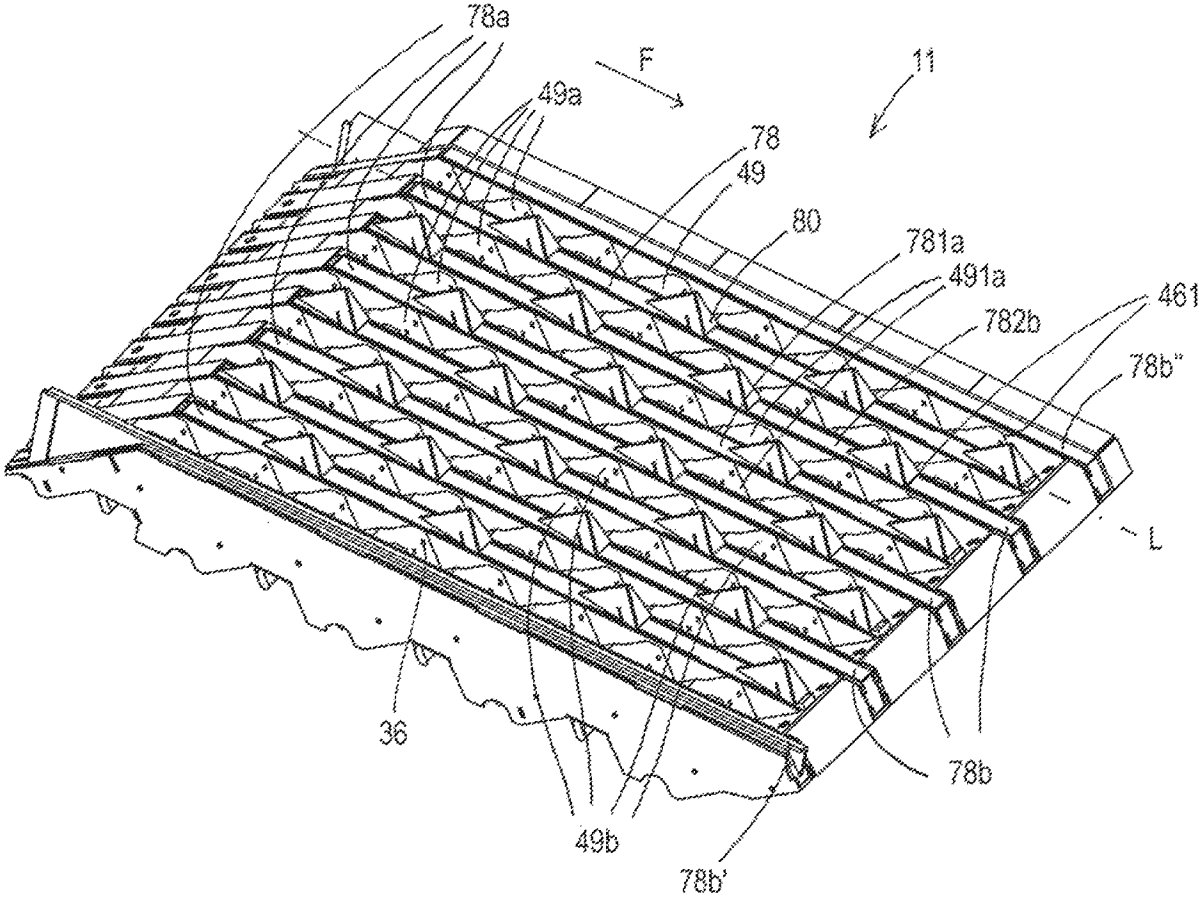
FIG. 7 shows a technical drawing of a separating grate of another incineration grate according to the invention, wherein the grate elements are in the form of grate blocks and grate beams.

The method is explained in greater detail below with reference to FIG. 7:

In the separating grate 11 shown in FIG. 7, a first set of grate elements is in the form of grate blocks 49 with corresponding air feeds 36, and a second set of grate elements is in the form of grate beams 78. In this case, the grate beams 78 have a longitudinal axis L extending in the conveying direction F and they extend over the entire length of the separating grate 11.

In the specific embodiment shown, the separating grate 11 is bounded laterally by respective fixed grate beams 78*b'* and 78*b''*, wherein four movable grate beams 78*a* and three fixed grate beams 78*b* are arranged alternately in the transverse direction between the lateral grate beams 78*b'*, 78*b''*. Eight grate blocks 49 are arranged one above the other in the manner of steps between the grate beams in the embodiment shown.

In the specific case, grate blocks 491*a* are secured laterally on in each case one first movable grate beam 781*a* in such a way that they are spaced apart on the side facing away from the first grate beams 781*a* from an adjacent second fixed grate beam 782*b*, with the result that a gap 461 is formed, through which the fine fraction constituents of the slag are ejected into the fine slag discharge chamber.

The grate blocks 49 arranged one above the other in the manner of steps in the conveying direction F are secured alternately on a movable grate beam 78*a* and on a fixed grate beam 78*b* adjacent thereto.

During operation, the movable grate beams 78*a* are moved backward and forward in the conveying direction, as a result of which the grate blocks 49*a* secured on said grate beams are pushed backward and forward by the respective fixed grate beam 49*b* following in the conveying direction. In this case, the cross section of the gap 461 formed between grate block 49 and grate beam 78 is also varied continuously, i.e. the gap length is either reduced or increased during a forward movement and correspondingly increased or reduced during a reverse movement. On the one hand, this results in an optimum screening effect and, on the other hand, jamming of bulky slag constituents is counteracted in an effective manner.

On their upper side facing the slag, the grate beams 78 furthermore have wedge-shaped deflection elements 80.

In this case, the deflection elements 80 of grate beams 78 that follow one another in the transverse direction are arranged offset relative to one another in respect of the conveying direction F and describe a zigzag line.

By means of the deflection elements 80, a meandering course of different subsidiary slag flows is obtained during operation, this being particularly advantageous in respect of a good screening effect.

It is furthermore conceivable for the grate beams 78 to assume the function of the distribution device for the air feeds of the grate blocks 49 arranged on the respective grate beam.

LIST OF REFERENCE SIGNS

2 combustion chamber
4 refuse feed hopper
6 refuse chute
8 inlet
9 charging ram
10 incineration grate
10*a-f* incineration grate sections
10*i-iii* incineration grate segments
11 separating grate
12*a-d* drives of the incineration grate
14*a-d* undergrate air chamber
16*a-d* primary air feed
17 slag removal device
34 fine slag discharge chamber
36 air feeds of the incineration grate
36*a, b* first and second group of air feeds
38; 38*e-f* air blower
40*a, b* air lines
42*a, b* air distributor rails
43 heat exchanger
44 grate plate
45 fan
46; 46*a-d* openings
461 gap
47 pump
48*a, b* grate step
49 grate block
50 fine slag discharge means
51*a*, 51*b* fine slag shutoff slide
52 hopper
53, 53' upper wall (supporting surface) of the
54 grate element
54 hopper neck
55, 55' front wall of the grate element
56 passage of the hopper neck
58 conveyor belt
60 coarse slag ejection edge
64 disk screen
66 coarse slag ejection chute
70 coarse slag collecting trough
76 refuse grab
78 grate beams
80 deflection elements
F conveying direction
L longitudinal axis of the grate beams

The invention claimed is:

1. A method comprising processing slag occurring in a combustion chamber of a refuse incineration plant that is produced by the refuse that is burned on an incineration grate and at the same time conveyed in the direction of a slag removal device, wherein:

the slag comprises a fine fraction and a coarse fraction, the incineration grate is formed at least in its end region that is facing the slag removal device as a separating grate, which has openings, via which the combustion chamber is connected to a fine-slag discharge chamber, and the fine fraction of the slag is separated from the course fraction and ejected through the openings into the fine-slag discharge chamber and discharged to the outside in a substantially dry state, the remaining coarse fraction is fed to the slag removal device and discharged to the outside, and the separating grate has at least in certain regions air feeds that are distributed over its entire width and via which air is fed in a controlled manner to the slag, and the air feeds are isolated from the openings and formed separately.

2. The method as claimed in claim 1, wherein the fine-slag discharge chamber is assigned a fine-slag discharger that discharges the fine fraction of the slag to the outside substantially in an airtight manner.

3. The method as claimed in claim 2, wherein the fine-slag discharger forms a lock.

4. The method as claimed in claim 1, wherein the fine fraction contains only particles, the maximum particle size of which is at most 12 mm.

5. The method as claimed in claim 1, wherein the incineration grate is designed as a separating grate only in its end region facing the slag removal device.

6. The method as claimed in claim 1, wherein the separating grate has openings of different cross-sectional areas, wherein the extent of the cross-sectional area of the openings increases when viewed in the conveying direction.

7. An incineration grate, comprising a plurality of grate elements, which rest one upon the other in the manner of steps in a conveying direction of refuse to be burned and thus form grate steps, wherein the incineration grate is designed as a separating grate, at least in the end region thereof situated downstream in the conveying direction, which separating grate has openings configured to separate a fine fraction of the slag from a course fraction of the slag and eject the fine fraction, wherein the separating grate has at least in certain regions air feeds that are distributed over its entire width for the controlled supply of air to the slag, and the air feeds are isolated from the openings and formed separately.

8. The incineration grate as claimed in claim 7, wherein at least some of the grate elements comprise a body which has an upper wall, which forms a supporting surface, and a wall at the front when viewed in the conveying direction of the incineration grate.

9. The incineration grate as claimed in claim 7, wherein the openings are in the form of gaps between the grate elements.

10. The incineration grate as claimed in claim 9, wherein the gaps between the grate elements are each formed by two grate elements spaced apart in the transverse direction.

11. The incineration grate as claimed in claim 7, wherein the grate elements are designed in such a way as to turn over and/or convey the slag by means of feed movements performed relative to one another.

12. The incineration grate as claimed in claim 11, wherein a cross section of the openings is varied during a feed movement.

13. The incineration grate as claimed in claim 11, wherein a cross section of gaps forming the openings is varied during a feed movement.

14. The incineration grate as claimed in claim 7, wherein the grate elements are grate blocks and a plurality of grate blocks arranged adjacent to one another across the width of the grate in each case forms a grate step.

15. The incineration grate as claimed in claim 7, wherein the openings of the separating grate are designed in such a way as to allow through only particles with a maximum particle size of at most 12 mm.

16. The incineration grate as claimed in claim 7, wherein the proportion of the sum of the cross-sectional area of the openings and the air feeds to the total area of the separating grate facing the slag is more than 5%.

17. A combustion chamber for a refuse incineration plant comprising an incineration grate, wherein:

the incineration grate comprises a plurality of grate elements, which rest one upon the other in the manner of steps in a conveying direction of refuse to be burned and thus form grate steps, the incineration grate is designed as a separating grate, at least in the end region thereof situated downstream in the conveying direction, which separating grate has openings configured to separate a fine fraction of the slag from a course fraction of the slag and eject the fine fraction, and the separating grate has at least in certain regions air feeds that are distributed over its entire width for the controlled supply of air to the slag, and the air feeds are isolated from the openings and formed separately.

18. The combustion chamber as claimed in claim 17, wherein the openings of the separating grate are designed in such a way as to allow through only particles with a maximum particle size of 12 mm.

* * * * *